US006863153B1

(12) United States Patent
Hayakawa et al.

(10) Patent No.: US 6,863,153 B1
(45) Date of Patent: Mar. 8, 2005

(54) LOUDSPEAKER DIAPHRAGM

(75) Inventors: Junichi Hayakawa, Kawasaki (JP); Masaya Kasai, Kodaira (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 0 days.

(21) Appl. No.: 09/720,028

(22) PCT Filed: Apr. 24, 2000

(86) PCT No.: PCT/JP00/02662

§ 371 (c)(1),
(2), (4) Date: Dec. 20, 2000

(87) PCT Pub. No.: WO00/65870

PCT Pub. Date: Nov. 2, 2000

(30) Foreign Application Priority Data

Apr. 22, 1999 (JP) ..... 11-114309

(51) Int. Cl.[7] ..... G10K 13/00
(52) U.S. Cl. ..... 181/173; 181/157
(58) Field of Search ..... 381/424, 423, 381/428, 432; 181/157, 167, 169, 172, 173, 174, 171, 175, 165, 164, 160

(56) References Cited

U.S. PATENT DOCUMENTS

| | | | | |
|---|---|---|---|---|
| 4,544,805 A | * | 10/1985 | Sawafuji | 181/173 |
| 4,881,617 A | * | 11/1989 | Faraone | 181/164 |
| 5,256,837 A | | 10/1993 | Pak | |
| 5,521,886 A | * | 5/1996 | Hirosawa et al. | 367/174 |
| 5,647,007 A | * | 7/1997 | Wooderson et al. | 381/332 |

FOREIGN PATENT DOCUMENTS

| | | |
|---|---|---|
| JP | 57-200996 | 12/1982 |
| JP | 60-213198 | 10/1985 |
| JP | 61-150499 | 7/1986 |
| JP | 64-067100 | 3/1989 |
| JP | 11-075290 | 3/1999 |

OTHER PUBLICATIONS

International Search Report.

Notification of Refusal Reason, Japanese Patent Office, Aug. 26, 2003.

* cited by examiner

*Primary Examiner*—Kimberly Lockett
(74) *Attorney, Agent, or Firm*—Eric J. Robinson; Robinson Intellectual Property Law Office, P.C.

(57) ABSTRACT

A speaker diaphragm 10 is provided having an improved quality of radiation sounds and a good outer appearance. The speaker diaphragm has in its slanted area projections typically represented by a peak line 4 and recesses typically represented by a bottom line 5. The projection typically represented by the peak line extends radially from the central area to the edge portion, and curves along the circumferential direction as it comes near to the edge portion. While the speaker diaphragm 10 vibrates at a large amplitude and moves toward the bottom side thereof, a rotation force is applied to air which is likely to concentrate upon the central area to thereby lower the air pressure to the central area. The speaker diaphragm 10 has a three-dimensional structure like a screw propeller so that the mechanical strength of the speaker diaphragm 10 can be increased over the whole area thereof and division vibrations can be suppressed. The speaker diaphragm is manufactured by ejection molding of material containing polypropylene as it main composition so that a variety of colors can be easily used during manufacture processes. In cooperation with the unique structure like the screw propeller, a strong visual impression is given.

6 Claims, 4 Drawing Sheets

LOUDSPEAKER DIAPHRAGM

FIELD OF THE INVENTION

The present invention relates to a speaker diaphragm, and more particularly to a speaker diaphragm having a good quality of radiation sounds and an excellent outer appearance.

Conventionally, a speaker diaphragm is mechanically reinforced by using ribs or the like. Such ribs are used to prevent distortion of radiation sounds by suppressing generation of division vibrations of the speaker diaphragm and flattening the frequency characteristics.

An example of a speaker diaphragm having such ribs is shown in the plan view of FIG. 6.

As shown in FIG. 6, this speaker diaphragm is formed with radially disposed projections 30 which are used as ribs. The projections 30 of the speaker diaphragm increases the mechanical strength along the radial direction of the speaker diaphragm to suppress generation of division vibrations having nodes along the circumferential direction.

In Japanese Utility Model laid-open No. 2-8249 gazette, a cone type speaker diaphragm integrally formed with spiral ribs is disclosed.

DESCRIPTION OF THE RELATED ART

A speaker diaphragm having ribs such as those shown in FIG. 6 is not mechanically reinforced in the area where the ribs are not formed. Therefore, the mechanical strength of the speaker diaphragm is not efficiently improved over the whole area. A speaker diaphragm having conventional ribs cannot efficiently suppress division vibrations, particularly division vibrations having nodes along the radial direction.

When a speaker diaphragm having ribs such as those shown in FIG. 6 vibrates at a large amplitude, an air flow on the surface of the speaker diaphragm is linear from the outside to inside, similar to a speaker diaphragm without ribs. Therefore, while the speaker diaphragm vibrates at a large amplitude, air is likely to press the central area of the speaker diaphragm, and the motion of the speaker diaphragm is hindered to thereby lower the quality of radiation sounds.

The ribs of a conventional speaker diaphragm such as those shown in FIG. 6 have linear shapes and a viewer receives only a simple impression.

Also in the case of the cone type speaker diaphragm disclosed in Japanese Utility Model laid-open No. 2-8249 gazette, ribs are disposed locally and the mechanical strength cannot be increased over the whole area of the cone type speaker diaphragm. It is not possible to mitigate an air pressure in the central area of the speaker diaphragm.

The present invention has been made under the above-described circumstances. It is an object of the present invention to provide a speaker diaphragm having a good quality of radiation sounds.

It is another object of the present invention to provide a speaker diaphragm having an excellent outer appearance,

SUMMARY OF THE INVENTION

In order to achieve the above objects, according to a first aspect of the present invention, there is provided a speaker diaphragm having a generally cone shape, comprising:

a plurality of projections forming a periodical structure along a circumferential direction in a slanted area of the speaker diaphragm, each projection extending radially from a central area to an edge portion and curving along the circumferential direction as the speaker diaphragm comes near to the edge portion; and a plurality of recesses formed between the plurality of projections, wherein at least one surface is curved in an area from each projection to each recess.

The projection extending radially in the slanted area curves along the circumferential direction as the speaker diaphragm comes near to the edge portion. While the speaker diaphragm vibrates at a large amplitude and the central area and the slanted area move toward the bottom side, a force along the circumferential direction can be applied to air which is likely to concentrate upon the central area, so that the air can be rotated. An air pressure to the speaker diaphragm can be lowered so that the quality of radiation sounds can be improved.

One surface in an area from each projection to each recess preferably has a bent portion. The mechanical strength of the speaker diaphragm along the radial direction can therefore be increased to suppress division vibrations and improve the quality of radiation sounds.

The odd number of projections as counted along the circumferential direction are preferably formed, and the projection has preferably a cross section like a screw propeller. Division vibrations having nodes in the radial direction can be forcibly suppressed and the quality of radiation sounds can be improved.

A bottom area of each recess is preferably made thicker than another area. Generation of division vibrations in the slanted area can be forcibly suppressed and the quality of radiation sounds can be improved.

According to a second aspect of the present invention, there is provided a speaker diaphragm having a general cone shape, the speaker diaphragm having projections and recesses forming a screw propeller shape to give a force along the circumferential direction to air flowing toward a central area of the speaker diaphragm.

According to the present invention, a force along the circumferential direction is applied to air which is likely to flow toward the central area, so that the air pressure to the central area can be lowered. Sounds can be efficiently radiated and the quality of sounds can be improved.

The speaker diaphragm is preferably manufactured by ejection molding of material containing polypropylene as a main composition. The speaker diaphragm having a characteristic structure can be manufactured easily. By using a variety of colors, an excellent outer appearance with a visually strong impression can be provided.

EMBODIMENT OF THE INVENTION

A speaker diaphragm according to an embodiment of the invention will be described with reference to the accompanying drawings.

Figure 1:
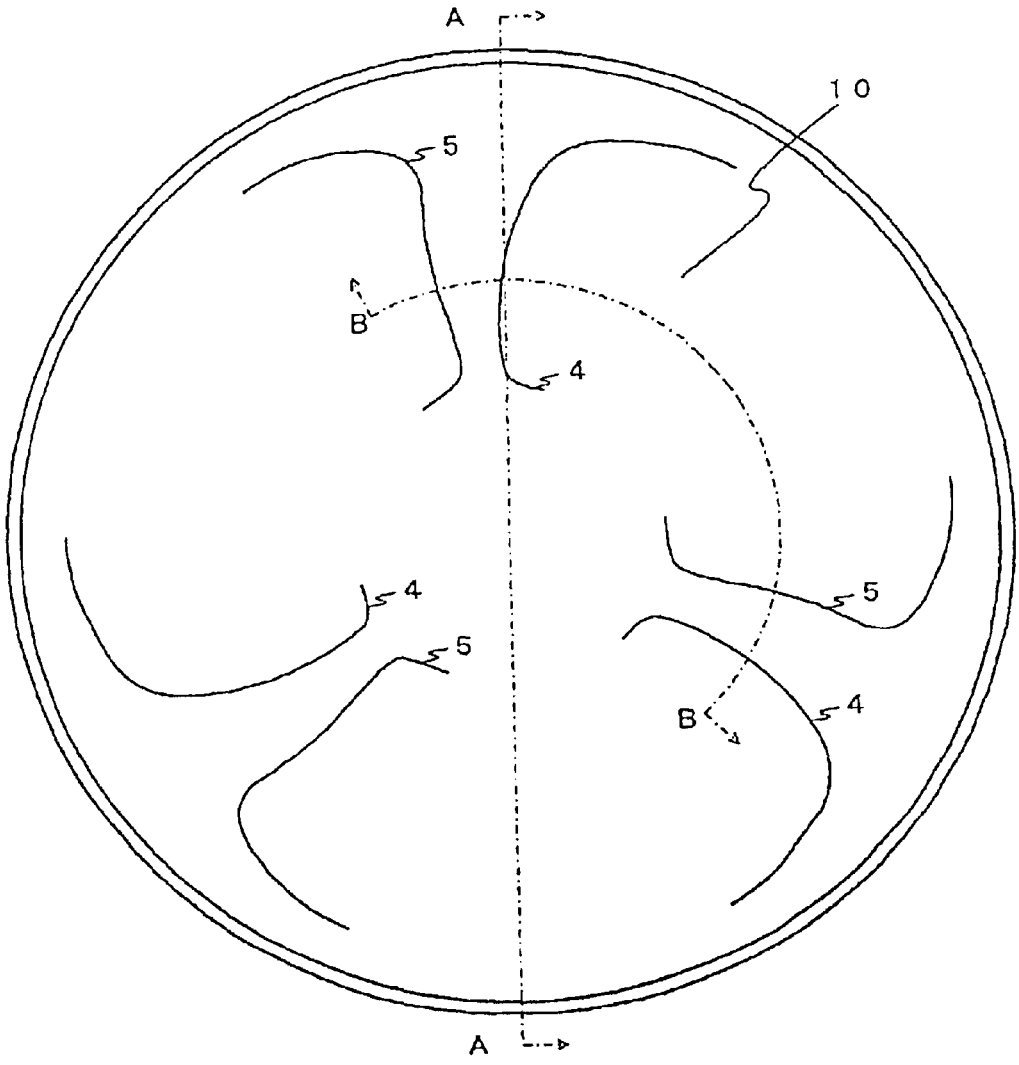
FIG. 1 is a plan view of a speaker diaphragm according to an embodiment of the invention.
Figure 2:
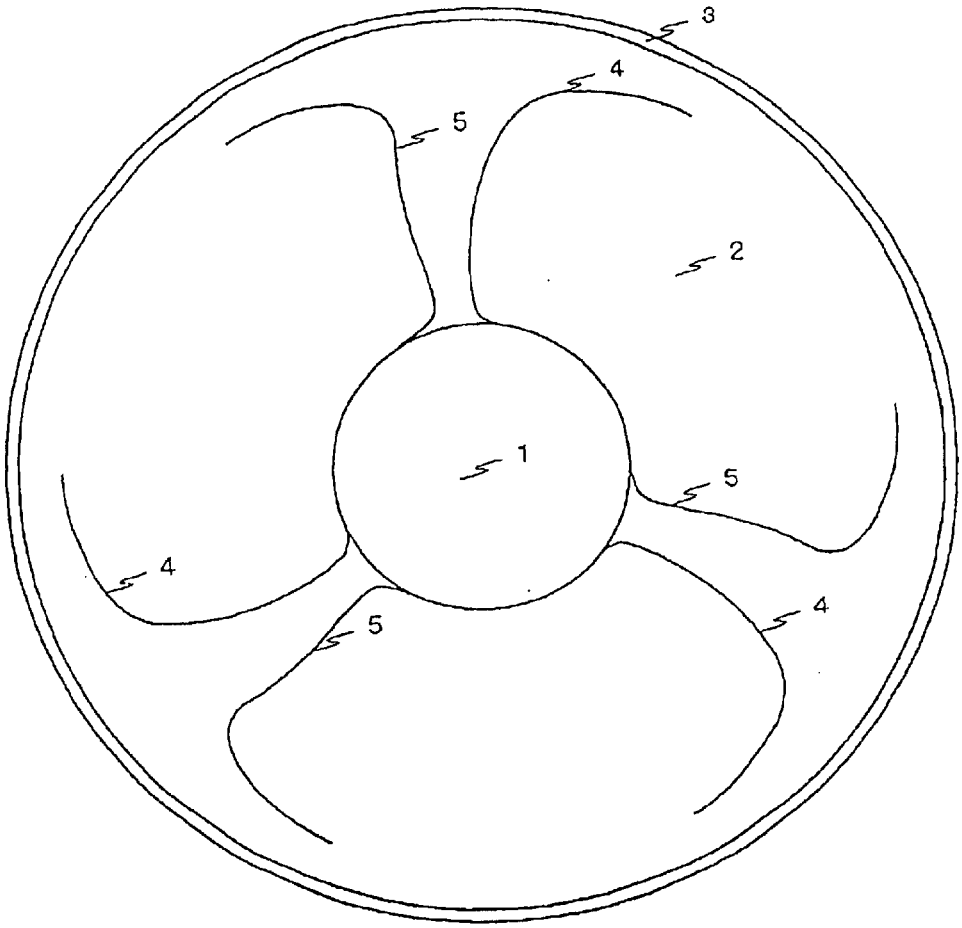
FIG. 2 is a plan view showing each divided area of the speaker diaphragm of the embodiment.

FIG. 1 is a plan view of a speaker diaphragm 10 according to an embodiment of the invention. FIG. 2 is a plan view showing each divided area having a structural difference of the speaker diaphragm 10 so as to facilitate the description relating to the speaker diaphragm 10.

The speaker diaphragm 10 has, for example, a diameter of about 30 cm and can be manufactured by ejection molding of resin containing polypropylene as its main composition. As shown in FIG. 2, the speaker diaphragm 10 is constituted of a central area 1, a slanted area 2, and an edge portion 3.

The central area 1 has a voice coil bobbin, for example, adhered at the bottom thereof and is used as a vibration generation source for vibrating the speaker diaphragm 10.

The slanted area 2 propagates vibrations in the central area 1 to peripheral air. As shown in FIG. 1, the slanted area 2 has a plurality of projections typically represented by a peak line 4 and a plurality of recesses typically represented by a bottom line 5.

In the example shown in FIG. 1, the slanted area 2 is has three projections typically represented by the peak line 4 and three recesses typically represented by the bottom line 5. The slanted area 2 can efficiently suppress division vibrations, particularly four-division vibrations considerably degrading the characteristics of the speaker diaphragm 10, among division vibrations having nodes along the radial direction. The slanted area 2 having three projections typically represented by the peak line 4 and three recesses typically represented by the bottom line 5 can also efficiently suppress division vibrations other than four-division vibrations.

Figure 3:
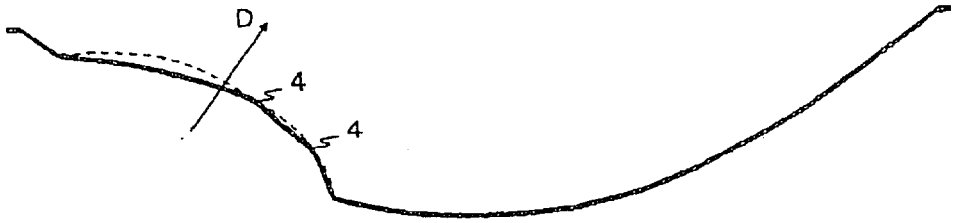
FIG. 3 is a cross sectional view of the speaker diaphragm of the embodiment.

FIG. 3 is a cross sectional view of the speaker diaphragm 10 as taken along line A—A shown in FIG. 1.

As shown in FIG. 3, the speaker diaphragm 10 has a generally cone shape basing upon a parabola shape, with the projection typically represented by the peak line 4. A broken line in FIG. 3 indicates a ridge of the projection drawn by the peak line 4.

As indicated by the peak line 4 shown in FIG. 1, the projection of the speaker diaphragm 10 extends radially from the central area 1 to the edge portion 3, and curves along the circumferential direction as it comes near to the edge portion 3. Namely, the projection and recess of the speaker diaphragm 10 form a shape like a screw propeller. Therefore, as the speaker diaphragm 10 vibrates, a rotation force is applied to the air flow on the surface of the speaker diaphragm 10.

Figure 4:
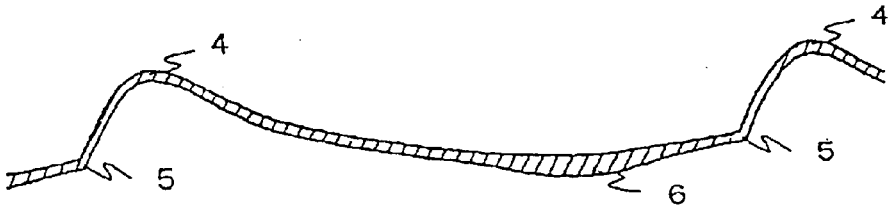
FIG. 4 is a cross sectional view of the speaker diaphragm of the embodiment.

FIG. 4 is a cross sectional view of the slanted area 2 of the speaker diaphragm 10 circumferentially taken along line B—B shown in FIG. 1, as viewed along a direction indicated by an arrow D in FIG. 2.

As shown in FIG. 4, one surface of the speaker diaphragm 10 extending from the projection represented by the peak line 4 to the recess is curved. The other surface opposite to the curved surface is, for example, curved from the peak line 4 to the bottom line 5 and bent at the bottom line 5. With this shape, the speaker diaphragm 10 has an emphasized outer appearance like the screw propeller and increases the mechanical strength of the projection functioning as a rib.

Also as shown in FIG. 4, a bottom area 6 of the recess of the speaker diaphragm 10 is made thicker than the other area. Therefore, the speaker diaphragm 10 can prevent division vibrations in the recess and improve the quality of radiation sounds.

The edge portion 3 shown in FIG. 2 is used for fixing the speaker diaphragm 10 to an audio apparatus. For example, the speaker diaphragm 10 is fixed to a frame with screws or to a cabinet of a speaker system with adhesive.

A specific example of the speaker diaphragm applied to an audio apparatus according to the embodiment of the invention will be described.

In mounting the speaker diaphragm 10 on the audio apparatus, a process similar to that used for a general speaker diaphragm can be used for mounting it. Specifically, the speaker diaphragm 10 is fixed to a frame with screws or to a cabinet of a speaker system with adhesive, and a voice coil bobbin is adhered to the bottom of the central area 1, to thereby constitute a magnetic circuit. By flowing current in the magnetic circuit, the speaker diaphragm 10 vibrates to generate radiation sounds.

Generally, while a speaker diaphragm vibrates at a large amplitude and moves toward the bottom side thereof, an atmospheric pressure in the central area of the speaker diaphragm lowers. Therefore, while the speaker diaphragm moves toward the bottom side, there is a tendency that air concentrates from the edge portion to the central area.

According to the speaker diaphragm 10 of the embodiment of this invention, it has a three-dimensional structure like the screw propeller, air flowing toward the central area 1 of the speaker diaphragm 10 can receive a rotation force.

Figure 5:
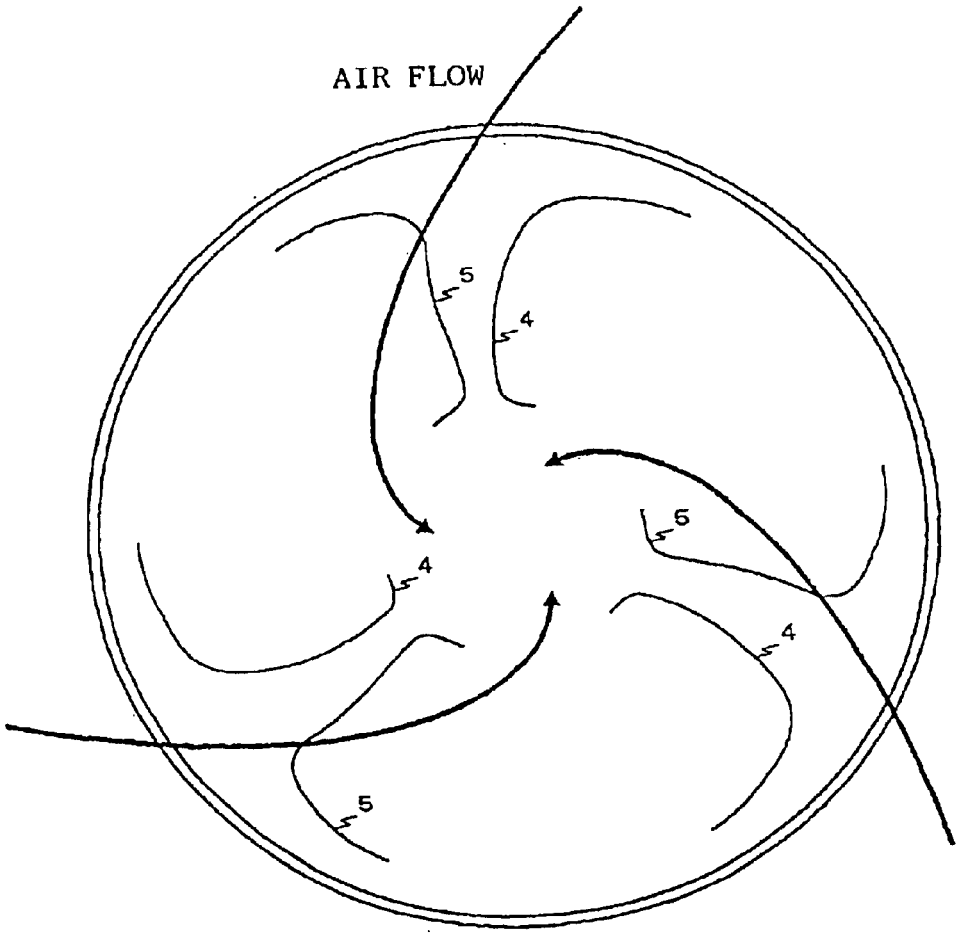
FIG. 5 is a diagram illustrating an air flow near the surface of the speaker diaphragm of the embodiment.
Figure 6:
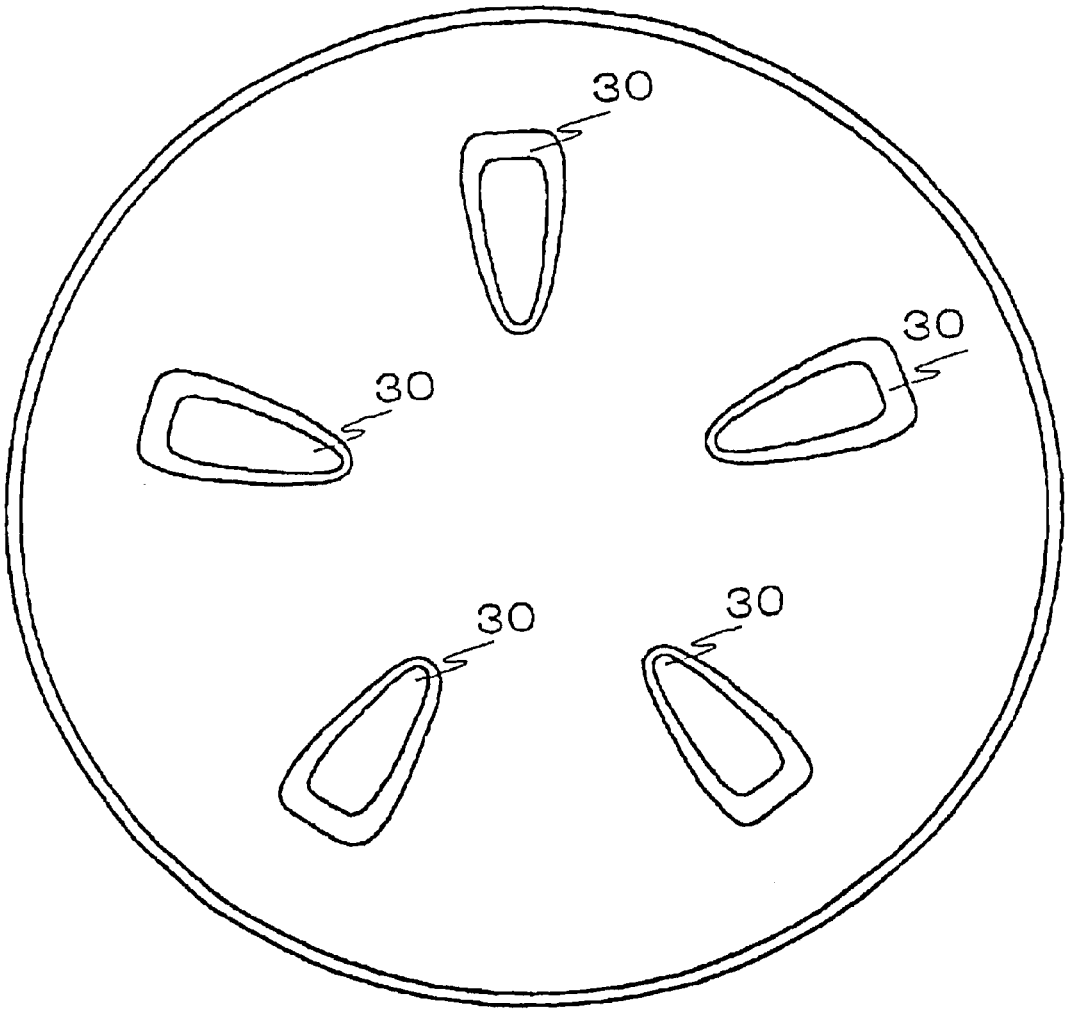
FIG. 6 is a plan view showing an example of a conventional speaker diaphragm.

FIG. 5 shows an air flow near the surface of the speaker diaphragm 10 while the speaker diaphragm 10 vibrates at a large amplitude and the central area 1 and slanted areas 2 thereof move toward the bottom side.

As shown in FIG. 5, in such a case, air which is likely to concentrate upon the central area 1 of the speaker diaphragm 10 near the surface thereof, receives the force along the circumferential direction by the projections of the speaker diaphragm 10 typically represented by the peak line 4. In other words, the projections of the speaker diaphragm 10 give the rotation force to the air which is likely to concentrate upon the central area of the speaker diaphragm 10.

It is therefore possible to lower the air pressure to the central area 1 of the speaker diaphragm 10 and efficiently radiate sounds at a large sound volume.

The slanted area 2 has three projections typically represented by the peak line 4 and three recesses typically represented by the bottom line 5. Therefore, the speaker diaphragm 10 can forcibly suppress division vibrations, particularly four-division vibrations considerably degrading the characteristics of the speaker diaphragm 10, among division vibrations having nodes along the radial direction.

The frequency characteristics of the speaker diaphragm 10 can therefore be made flat and the quality of radiation sounds can be improved.

Further, the bottom area 6 of the recess is made thicker than the other area so that division vibration in the recess of the speaker diaphragm 10 can be suppressed.

The frequency characteristics of the speaker diaphragm 10 can therefore be made flat and the quality of radiation sounds can be improved.

Furthermore, the recess of the speaker diaphragm 10 is bent along the bottom line 5 to increase the mechanical strength of the speaker diaphragm 10 along the radial direction. Division vibrations having node along the circumferential direction can therefore be suppressed.

The frequency characteristics of the speaker diaphragm 10 can therefore be made flat and the quality of radiation sounds can be improved.

Still further, the speaker diaphragm 10 can be manufactured by ejection molding of polypropylene. It is therefore easy to use a variety of colors during manufacture processes, so that a visually good outer appearance can be obtained. The speaker diaphragm 10 has the structure greatly different from that of a conventional speaker diaphragm and has a shape like the screw propeller. A strong visual impression can be given.

As described so far, in the speaker diaphragm 10, the slanted area has a plurality of projections and recesses, forming a three-dimensional structure like the screw propeller. The speaker diaphragm 10 can therefore lower the air pressure in the central area 1 by giving the rotation force to the air which is likely to concentrate upon the central area 1. It is also possible to forcibly suppress division vibrations having nodes along the radial and circumferential directions. The speaker diaphragm 10 can therefore improve the quality of radiation sounds.

It is easy to use a variety of colors during the manufacture process of the speaker diaphragm 10 and the structure itself is characteristic. An excellent outer appearance with a strong visual impression can be provided.

The invention is not limited only to the above-described embodiment, but various modifications and applications are possible. For example, in the embodiment, although the slanted area has three projections and three recesses, the number of projections and recesses may be set as desired so long as the mechanical strength of the speaker diaphragm can be increased and division vibrations can be suppressed. In this case, it is preferable to use the odd number of projections in order to forcibly suppress four-division vibrations which greatly degrade the characteristics of a speaker diaphragm.

The material of the speaker diaphragm is not limited only to polypropylene, but other resin capable of ejection molding may also be used.

INDUSTRIAL ADAPTABILITY

As described above, according to the present invention, the mechanical strength of the speaker diaphragm can be increased by incorporating the three-dimensional structure like the screw propeller, and the pressure applied to the surface of the speaker diaphragm can be lowered by giving the rotation force to air which is likely to flow toward the central area. It is therefore possible to efficiently suppress the generation of division vibrations and improve the quality of radiation sounds.

Further, according to the present invention, the speaker diaphragm has the three-dimensional structure like the screw propeller and coloring is easy during manufacture processes. An excellent outer appearance can therefore be provided.

What is claimed is:

1. A speaker diaphragm having a generally cone shape, comprising:

a plurality of projections forming a periodical structure along a circumferential direction in a slanted area of the speaker diaphragm, each projection extending radially from a central area to an edge portion and curving along the circumferential direction as the speaker diaphragm comes near to the edge portion; and a plurality of recesses formed between the plurality of projections, wherein at least one surface is curved in an area from each projection to each recess, and wherein the odd number of projections are formed as counted along the circumferential direction, and the projection has a cross section like a screw propeller.

2. A speaker diaphragm according to claim 1, wherein one surface in an area from each projection to each recess has a bent portion.

3. A speaker diaphragm according to claims 1 or 2 wherein a bottom area of the recess is made thicker than another area.

4. A speaker diaphragm according to any one of claim 1, wherein the speaker diaphragm is manufactured by ejection molding of material containing polypropylene as a main composition.

5. A speaker diaphragm according to claim 2, wherein the speaker diaphragm is manufactured by ejection molding of material containing polypropylene as a main composition.

6. A speaker diaphragm according to claim 3, wherein the speaker diaphragm is manufactured by ejection molding of material containing polypropylene as a main composition.

* * * * *